United States Patent [19]

Cheney

[11] Patent Number: 4,519,349

[45] Date of Patent: May 28, 1985

[54] WATER EJECTOR FUEL SYSTEM

[75] Inventor: Jack E. Cheney, Haslett, Mich.

[73] Assignee: Schmelzer Corporation, Flint, Mich.

[21] Appl. No.: 439,744

[22] Filed: Nov. 8, 1982

[51] Int. Cl.[3] ..... F02B 77/06

[52] U.S. Cl. ..... 123/198 R; 123/510; 123/514

[58] Field of Search ..... 123/25 R, 198 R, 1 R, 123/510, 514; 210/112, 114, 117, 184

[56] References Cited

U.S. PATENT DOCUMENTS 4,257,890 3/1981 Hurner ..... 210/112

4,296,723 10/1981 Aldrich ..... 123/25 R 4,372,847 2/1983 Lewis ..... 210/114

4,437,986 3/1984 Hutchins et al. ..... 210/184

*Primary Examiner*—Ira S. Lazarus

*Attorney, Agent, or Firm*—Harness, Dickey & Pierce

[57] ABSTRACT

Apparatus for ejecting water from a fuel system having a fuel reservoir with a water trap which is open to a pump in the presence of water and closed in the absence of water. The pump operates each time the engine is started to receive a charge of water and each time the engine is stopped to discharge the charge of water to the exterior of the reservoir.

20 Claims, 3 Drawing Figures

WATER EJECTOR FUEL SYSTEM

This invention relates to fuel systems for internal combustion engines and more particularly to apparatus for ejecting water from the fuel system.

All diesel fuel contains a percentage of water some of which typically settles to the bottom of the tank or reservoir. However, once the engine is started and the vehicle begins movement, water becomes disturbed and becomes entrained in the fuel pumped into the fuel supply lines and filtering system. Such water can freeze and disable the vehicle. For that reason, large diesel trucks are provided with drains which permit draining accumulated water onto the ground before operation of the engine begins. Unfortunately, such arrangements are not practical for passenger vehicles and also result in waste of fuel, some of which typically is drained onto the ground with the water.

With the present invention, a water trap is formed at the bottom of the fuel reservoir in which water which separates from the fuel can settle. Once accumulated within the water trap, mixing of the water and fuel is resisted by the shape of the water trap. The apparatus includes pump means having an inlet communicating with the water trap and an outlet communicating with the exterior of the fuel tank. Actuating means for operating the pump are disposed exterior of the fuel reservoir and are operated in response to starting and stopping of the engine. When the engine is started, a charge of water is drawn into a pump chamber and when the engine is stopped, the charge of water is discharged through the outlet through the exterior of the reservoir. The pump outlet at the exterior of the reservoir can communicate with a container, the exhaust system of the vehicle where the discharged water can evaporate, or can be discharged to the underside of the vehicle onto the ground. The water trap has an outlet communicating with the pump means under the control of a valve moved between an open and closed position by a float member. The float member is responsive to the presence of water in the water trap to open and to admit water to the inlet of the pump. On the other hand, if all of the water has been ejected, the float member permits the water trap valve to close so that flow of liquid from the reservoir to the pump is prevented thereby avoiding waste of fuel. The float member is formed to have a density less than water and greater than the fuel so that in the presence of water, the float is buoyant and in the presence of fuel alone there is no effect on the float.

Preferred embodiments of the invention are disclosed with reference to the following drawings in which.

Figure 1:
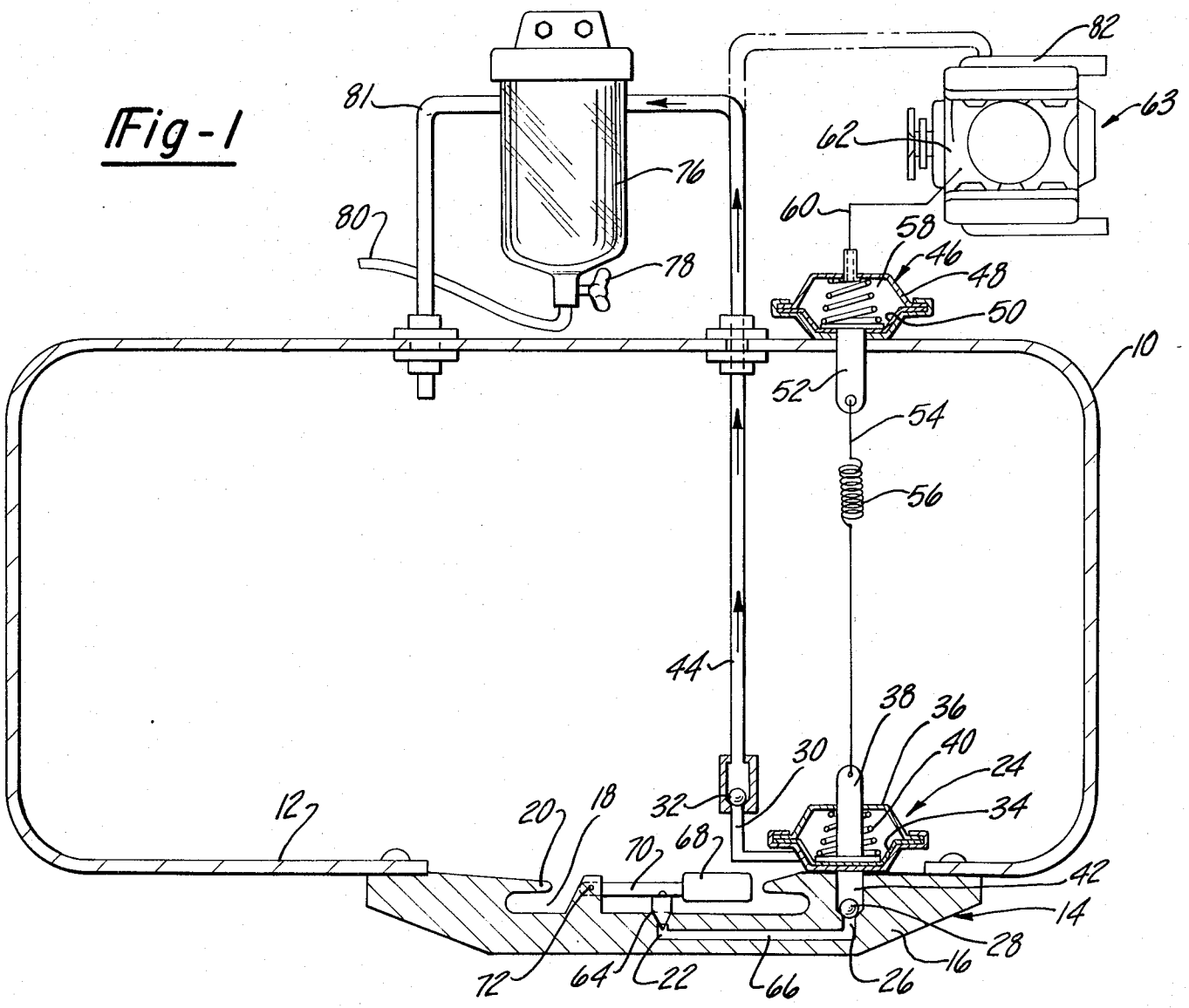
FIG. 1 is a cross-sectional view of a fuel system with apparatus for ejecting water embodying the invention.

Referring to FIG. 1, a vehicle fuel system is illustrated having a tank 10 for storing fuel. The bottom wall 12 of the tank is provided with a water trap designated generally at 14. The water trap 14 includes a body member 16 attached to the outside of the bottom wall 12. The body member 16 includes a water receiving recess 18 in which water accumulates upon separation from the fuel, for example diesel fuel. The specific gravity of the water is higher than that of the fuel and it consequently separates and accumulates in the recess 18. The upper edge of the recess 18 is defined by a lip 20 around the perimeter which acts to retain water once it has entered the recess.

The recess 18 in the water trap 14 has an outlet passage 22 communicating with pump means designated generally at 24 and including an inlet passage 26 controlled by a one-way check valve 28 and an outlet passage 30 controlled by a one-way check valve 32. The pump means 24 further includes reciprocating means in the form of a diaphragm 34 and is slidably supported in the wall of the housing 36. A spring 40 surrounds the stem 38 and has one end acting against the housing 36 and the other end against the diaphragm 34 to urge the latter to the position illustrated in the drawings. Upon upward movement of the stem 38 from the position illustrated, a suction is created lifting the check valve 28 to permit fluid to enter the pump cavity 42. When the reciprocating member 34 moves in the opposite direction under the influence of the spring 40, fluid in the pump cavity 42 is pumped through the outlet passage 30 and around the open outlet check valve 32 to the discharge passage 44.

The pump means 24 are operated by actuating means indicated at 46 in the form of a vacuum operated motor having a housing 48 containing a flexible diaphragm 50. The diaphragm 50 supports a stem 52 for sliding movement in the wall of the housing 48. The stem 52 is connected by way of a flexible link such as a cable 54 and spring 56 with the stem 38. The housing 48 forms an actuating chamber 58 at one side of the diaphragm 50 which is in communication by a line 60 with the intake manifold 62 of an internal combustion engine 63 using the tank 10 as its fuel source. When the engine is started to establish vacuum pressure at the intake manifold 62, the diaphragm 34 is moved in an intake direction, that is upwardly, to open inlet valve 28 to admit water and when the engine is turned off, thereby terminating the source of vacuum at the intake manifold 62, the diaphragm 50 and stem 52 move downwardly permitting the spring 40 to move the diaphragm 34 in a discharge direction so that water is forced past the outlet check valve 32.

The water trap outlet 22 communicating with the recess 18 is controlled by valve 64 moveable between a closed position illustrated in FIG. 1 and an open position in which water in the recess 18 enters the passage 66 connecting the outlet 22 and the inlet 26. Movement of the valve 64 between open and closed positions is under the control of a float 68 connected to the outer end of an arm 70 pivoted at 72. The valve 64 is supported by the arm 70 and the float 68 is responsive to the presence of water in the recess 18. For this purpose, the float 68 is balanced to have a density less than water and greater than the fuel in the tank 10. As a result, whenever water separates from the fuel and accumulates in the recess 18, the float raises to open the valve 64 permitting the flow of water to the passage 66.

Each time the engine 63 is started to establish a source of vacuum pressure at the manifold 62, the pump means 24 is actuated in its suction direction to accept a charge of water at the pump cavity 42 and when the engine is stopped, the diaphragm 34 moves downwardly in the discharge direction of the pump means 24 to eject water past the outlet valve 32.

If all of the water has been removed from the fuel, the valve 64 will return to its closed position and all subsequent pumping action of the pump means 24 during starting and stopping of the engine will be ineffective to pump any liquid thereby preventing the waste of any fuel.

Water which is pumped through the outlet passage 30 enters discharge passage 44 which is routed to the exterior of the tank 10. The conduit or passage 44 communicates with a container 76 which is made of clear plastic material so that the contents can be viewed. The bottom of the container is provided with a drain cock 78 communicating with a drain tube 80 which can be routed to the underside of the vehicle with which the tank 10 is associated so that the contents of the container 78 can be periodically drained. The container 76 also is provided with an overflow drain tube 81 which returns overflow back to the tank 10 thereby avoiding uncontrolled spillage of water on ground surfaces below the vehicle. As an alternative to the container 76, the conduit 44 can be routed to the exhaust system 82 of engine 63. In this manner, each time the engine 63 is stopped, a charge of water is discharged to the hot exhaust system where it is rapidly evaporated. The float 68 and valve 64 prevent discharge of any fuel into the exhaust system 82.

In the event that water accumulated at the bottom of the tank 10 should freeze, damage to the pump means 24 is prevented by the spring 56 interposed in the cable 54 which permits operation of the actuator 46 without imposing large forces on the pump.

Figure 3:
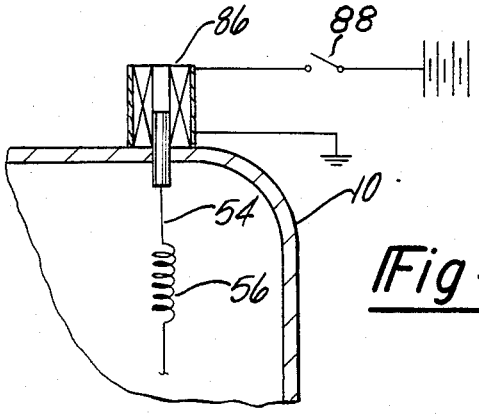
FIG. 3 shows a modification of one of the elements of the embodiment seen in FIG. 1.

Referring now to FIG. 3, an actuating member in the form of a solenoid 86 can be substituted for the actuating means 46. In that case, the solenoid 86 can be electrically connected to be energized upon closing of switch 88 which can be the ignition switch of a vehicle. Upon closing, the switch 88 to start the engine, the solenoid 86 is energized to pull upwardly on the cable 54 to operate the pump means 24. When the engine is turned off by opening the ignition switch 88, the cable 54 is permitted to move downwardly to permit operation of the pump 24 in its discharge direction.

Figure 2:
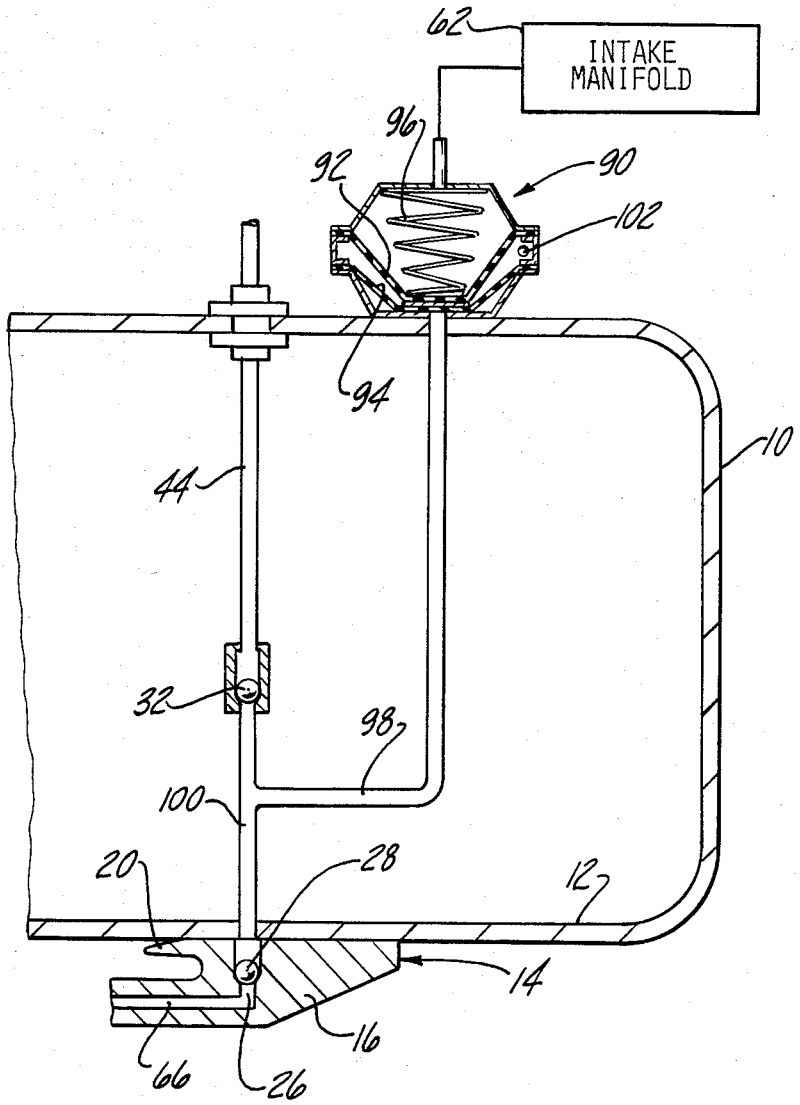
FIG. 2 is a view of a portion of the fuel system similar to FIG. 1 but showing another embodiment of the invention.

Another embodiment of the invention is illustrated in FIG. 2 in which the reciprocating means 34 of pump 24 and the actuating means 46 are combined in an operating assembly 90 mounted on the exterior of the tank 10. The operating assembly includes a pair of diaphragms 92 and 94 connected to move together as a unit. The diaphragms 92,94 are baised to the position shown in FIG. 2 by a spring 96. Upon establishing vacuum at the intake manifold 62, the diaphragms 92, 94 are moved upwardly with the diaphragm 92 performing the function of the diaphragm 50 in the actuating means 46 and the diaphragm 94 performing the function of the reciprocating means or pump diaphragm 34. Such upward movement causes a suction to be created in the passage 98 communicating with the pump chamber 100 formed between the intake valve 28 and valve 32. This causes water to move from passage 66 around open valve 28. Subsequently, when the engine is stopped and the source of vacuum pressure is eliminated, the spring 96 acts to return the diaphragms 92, 94 downwardly in the discharge direction so that water in the pump chamber 100 is discharged around the outlet valve 32 to the passage 44 and to the exterior of the tank 10.

The space between the diaphragms 92 and 94 is provided with a purge hole 102 so that in the event of leakage of the diaphragm 94, fuel will not be drawn into the intake manifold 62 of the vehicle.

Apparatus for ejecting water from a fuel system has been provided in which the bottom of a fuel reservoir is provided with a water trap under the control of a float operated valve such that the outlet of the water trap is open in the presence of water and closed in the absence of water. The open water trap communicates with a pump which operates each time the engine is started and stopped to receive and discharge water if the outlet to the water trap is open. In this manner, fuel is not unnecessarily pumped from the reservoir and the presence of water in this system is minimized.

The embodiments of the invention in which an exclusive property or privilege is claimed are defined as follows:

1. Apparatus for ejecting water from a fuel system of an internal combustion engine comprising: a fuel reservoir, pump means having an inlet communicating with said reservoir and an outlet communicating with the exterior of said reservoir, said pump means including reciprocating means movable in one direction to suck fluid to said inlet and movable in the other direction to discharge fluid at said outlet, and actuating means for moving said reciprocating means in said one direction upon starting said engine and in said other direction upon stopping said engine.

2. The apparatus of claim 1 wherein said actuating means is a vacuum operated device operative in response to vacuum pressure formed by said internal combustion engine upon starting said engine to move said reciprocating means in said one direction to receive fluid at said inlet and being operative in the absence of vacuum pressure resulting from stopping said engine to return said reciprocating means in said other direction to discharge fluid through said outlet.

3. The apparatus of claim 1 wherein said actuating means is an electrically operated solenoid operative in response to energizing the ignition circuit to move said reciprocating means in said one direction to receive fluid at said inlet and being operative in response to energizing said circuit to return said reciprocating means in said other direction to discharge fluid through said outlet.

4. The apparatus of claim 1 further comprising a water trap formed at the bottom of said reservoir to accumulate water separated from fuel in said reservoir and wherein said inlet of said pump means is connected to said water trap.

5. The apparatus of claim 4 and further comprising an outlet in said water trap communicating with said inlet of said pump means.

6. The apparatus of claim 5 and further comprising valve means in said outlet controlling the flow of water from said water trap and means responding to the presence of water in said water trap to move said valve to an open position to place said trap in fluid communication with said pump inlet.

7. The apparatus of claim 6 wherein said means responsive to the presence of water includes a float having a density less than water and more than the fuel in said reservoir whereby said valve means is open in the presence of water and closed in the presence of fuel.

8. The apparatus in claim 1 wherein said outlet is connected to the exhaust system of said vehicle to discharge water thereto and water therein.

9. The apparatus of claim 1 wherein said reciprocating means is a flexible diaphragm movable in said one direction to cause fluid to be received at said inlet and in said other direction to discharge fluid from said outlet.

10. The apparatus of claim 9 and further comprising resilient means urging said diaphragm in said other direction to discharge fluid at said outlet.

11. The apparatus of claim 1 wherein said reciprocating means is in the form of a first diaphragm and wherein said actuating means includes a second diaphragm, said first and second diaphragms being moveable as a unit in the presence of vacuum upon starting said engine to move said first diaphragm in said one direction and being responsive to the stopping of the engine and the absence of vacuum to move said diaphragm in said other direction to discharge fluid at said outlet.

12. The apparatus of claim 9 wherein said reciprocating means is in the form of a moveable wall disposed within said fuel reservoir and said actuating means is disposed outside of said reservoir.

13. The apparatus of claim 12 wherein said reciprocating means and the diaphragm of said actuating means are connected together by a flexible link.

14. The apparatus of claim 13 and further comprising a resilient member forming part of said link.

15. The apparatus of claim 4 wherein said water trap forms a recess at the bottom of said reservoir and wherein said recess has a perimeter with a projecting lip resisting movement of water from the trap.

16. Apparatus for ejecting water from a fuel system of an internal combustion engine comprising: a fuel reservoir, a water trap formed at the bottom of said reservoir to accumulate water separated from said fuel in said reservoir, pump means having an inlet and an outlet and a reciprocating means movable in opposite directions upon starting and stopping of an engine to receive fluid at said inlet and discharge fluid through said outlet, respectively, said trap having an opening communicating with the inlet of said pump, a valve controlling opening and closing of said trap opening and means responsive to the presence of water in said water trap to move said valve to an open position to place said trap in communication with said pump inlet and responsive to the absence of water to close said valve and isolate said trap from said pump inlet.

17. The apparatus of claim 16 wherein said means responsive to the presence of water includes a float having a density less than water and more than the fuel in said reservoir whereby said float moves upwardly in said trap in the presence of water.

18. The apparatus of claim 17 wherein said float is connected to one end of an arm having the other end pivoted relative to said water trap, said valve being connected to said arm for movement therewith.

19. The apparatus of claim 16 wherein a body member is attached to the bottom of said reservoir, said body member forming said water trap and forming the inlet of said pump means.

20. The apparatus of claim 16 wherein said outlet communicates with a water container disposed exterior of said housing.

* * * * *